US006348797B1

(12) United States Patent
Shimizu et al.

(10) Patent No.: US 6,348,797 B1
(45) Date of Patent: Feb. 19, 2002

(54) COMBUSTION STATE DETECTING APPARATUS FOR INTERNAL COMBUSTION ENGINE

(75) Inventors: Takeshi Shimizu; Mitsuru Koiwa; Yutaka Ohashi, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/499,344

(22) Filed: Feb. 8, 2000

(30) Foreign Application Priority Data

Sep. 16, 1999 (JP) ..... 11-262468

(51) Int. Cl.[7] ..... F02B 17/00
(52) U.S. Cl. ..... 324/399; 324/378
(58) Field of Search ..... 423/604, 656; 324/399, 378, 382, 388, 391, 393

(56) References Cited

U.S. PATENT DOCUMENTS 3,721,224 A * 3/1973 Zotto ..... 123/604
5,801,534 A * 9/1998 Hohner et al. ..... 324/399

FOREIGN PATENT DOCUMENTS

JP 4-342874 11/1992 ..... F02P/15/00

* cited by examiner

*Primary Examiner*—Safet Metjahic
*Assistant Examiner*—Vincent Q. Nguyen
(74) *Attorney, Agent, or Firm*—Sughrue Mion, PLLC

(57) ABSTRACT

A combustion state detecting apparatus for an internal combustion engine which can ensure adequate thermal insulation between a transformer and a bias circuit and which can be manufactured in a miniaturized structure. The apparatus includes a transformer (11) having a primary winding (111) and a secondary winding (112) which are so electromagnetically coupled mutually that upon interruption of a current flowing through the primary winding, a high voltage is induced at a high-potential end of the secondary winding, a switch (12) for controllably interrupting the current flowing through the primary winding, a spark plug (3) for generating a spark discharge in response to application of the high voltage at the high-potential end of the secondary winding, a bias circuit (13) for applying to a low-potential end of the secondary winding a voltage of plus polarity for detecting ions produced when the spark discharge occurs at the spark plug, and an outer packaging case (16) for accommodating therein the transformer, the switch and the bias circuit, wherein the bias circuit is disposed within the outer packaging case at a location adjacent to the switch remote from the transformer, and wherein the outer packaging case is filled with a moldable resin (17).

3 Claims, 7 Drawing Sheets

COMBUSTION STATE DETECTING APPARATUS FOR INTERNAL COMBUSTION ENGINE

BACKGROUND OF THE INVENTION

1. Field of the Invention

The present invention relates to a combustion state detecting apparatus for an internal combustion engine for detecting combustion states within a cylinder of the engine on the basis of detection of an ion current.

2. Description of Related Art

For having better understanding of the concept underlying the present invention, background techniques thereof will first be reviewed in some detail. FIG. 7 is a circuit diagram showing schematically a structure of a conventional combustion state detecting apparatus for an internal combustion engine (hereinafter also referred to simply as the engine). Referring to the figure, reference numeral 1 denotes an ignition device which is implemented in the form of a transformer 11 including a primary winding 111 having a high-potential end applied with a potential of plus polarity and a low-potential end connected to a collector of a power transistor serving as a switching element 12, which transistor having an emitter electrode connected to the ground potential. The transformer (ignition coil) 11 further includes a secondary winding 112 which is coupled electromagnetically to the primary winding 111 and which has a high-potential end connected to a spark plug 3 and a low-potential end connected to a bias circuit disposed externally by way of a wiring conductor.

Further referring to FIG. 7, numeral 2 (single-dotted broken line block) denotes generally a combustion state detecting module which is comprised of a bias circuit 13 for applying to the low-potential end of the secondary winding 112 a bias voltage of plus polarity required for detecting ions produced upon occurrence of a spark discharge at the spark plug 3. To this end, the bias circuit 13 is constituted by a series circuit of a parallel connection of a diode 133 and a resistor 131 and a parallel connection of a Zener diode 134 and a capacitor 132. Connected to the output terminal of the bias circuit 13 is an ion current detecting means for detecting a current flowing through the spark plug 3 under the effect of the bias voltage charged in the capacitor 132. Further connected between the output of the bias circuit 13 and the ground is a diode 21 which forms a discharge current path for the spark plug 3.

With the structure of the conventional combustion state detecting apparatus for an internal combustion engine including the ignition device 1 and the combustion state detecting module 2 as described above, there may arise such problems as elucidated below. It is assumed that a breakage fault takes place at a circuit point (A) where the high-potential end of the secondary winding and the spark plug are interconnected or assumed that a misfire event (i.e., noncombustion of the air/fuel mixture) occurs within the cylinder in which the spark plug 3 is disposed. In that case, the voltage (having a peak level of about 40 kV) appearing at the high-potential end of the secondary winding 112 undergoes vibration, as a result of which a voltage vibration having a peak level of about 8 kV makes appearance at the low-potential end of the secondary winding 112 in synchronism with the voltage vibration at the high-potential end, although the amplitudes of both the voltage vibrations differ from each other. As a consequence, the voltage of relative high level making appearance at the low-potential end of the secondary winding 112 brings about a leak current which flows through the electronic circuitry constituting the ion current detecting means incorporated in the combustion state detecting module 2, whereby the electronic circuitry constituting the ion current detecting means may undergo damage or injury, giving rise to a problem.

As the measures for coping with the problem mentioned above, it is conceivable to accommodate the high-voltage circuitry inclusive of the bias circuit 13 within an outer packaging case which houses therein the ignition device 1 and fills the interior of the outer packaging case 16 with a curable casting resin to thereby insulate the ignition device and the high-voltage circuitry from each other. In this conjunction, it is however noted that the capacitor 132 constituting a part of the bias circuit 13 is relatively low in respect to the heat withstanding capability and thus the capacitor may provide a cause for lowering the reliability of operation of the combustion state detecting apparatus under the heat transferred from the primary winding 111, giving rise to a problem. Besides, the number of parts to be housed within the outer packaging case of the ignition device 1 will increase, which involves a problem that the size of the combustion state detecting apparatus increases unfavorably.

SUMMARY OF THE INVENTION

In the light of the state of the art described above, it is an object of the present invention to provide a combustion state detecting apparatus for an internal combustion engine which can ensure adequate thermal insulation between a transformer constituting an ignition coil and the bias circuit and which can be manufactured in a miniaturized structure.

In view of the above and other objects which will become apparent as the description proceeds, there is provided according to a general aspect of the present invention a combustion state detecting apparatus for an internal combustion engine, which apparatus includes a transformer having a primary winding and a secondary winding which are so electromagnetically coupled mutually that upon interruption of a current flowing through the primary winding, a high voltage is induced at a high-potential end of the secondary winding, a switching means for controllably interrupting the current flowing through the primary winding, a spark plug for generating a spark discharge in response to application of the high voltage making appearance at the high-potential end of the secondary winding, a bias means for applying to a low-potential end of the secondary winding of the transformer a voltage of plus polarity for detecting ions produced when the spark discharge occurs at the spark plug, and an outer packaging case for accommodating therein the transformer, the switching means and the bias means, wherein the bias means is accommodated within the outer packaging case such that the bias means is disposed at a location adjacent to the switching means remotely from the transformer, and wherein the outer packaging case is filled with a curable casting resin.

By virtue of the structure mentioned above, the bias means can positively be protected from influence of heat generated in the primary winding, and thus there can be realized the combustion state detecting apparatus which operates with high reliability.

In a preferred mode for carrying out the invention, the combustion state detecting apparatus may further include a first wiring conductor for electrically interconnecting a low-potential end of the primary winding of the transformer and the switching means, a second wiring conductor for electrically interconnecting a high-potential end of the secondary winding of the transformer and the bias means, wherein the first and second wiring conductors are formed discretely from each other, and wherein the second wiring conductor is disposed at inner side relative to the first wiring conductor.

Owing to the structure mentioned above, degree of freedom in disposing the second wiring conductor relative to the first wiring conductor increases, whereby an adequate insulation distance can easily be ensured between the bias means and the transformer notwithstanding of a narrow internal space available within the outer packaging case.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIGS. 5A to 5C are views showing outer appearance of the ignition device in the assembled state, wherein FIG. 5A is a front view of the ignition device;

FIG. 5B is a top plan view of the same; and

FIG. 5C is a side elevational view of the same;

DESCRIPTION OF THE PREFERRED EMBODIMENTS

Figure 1:
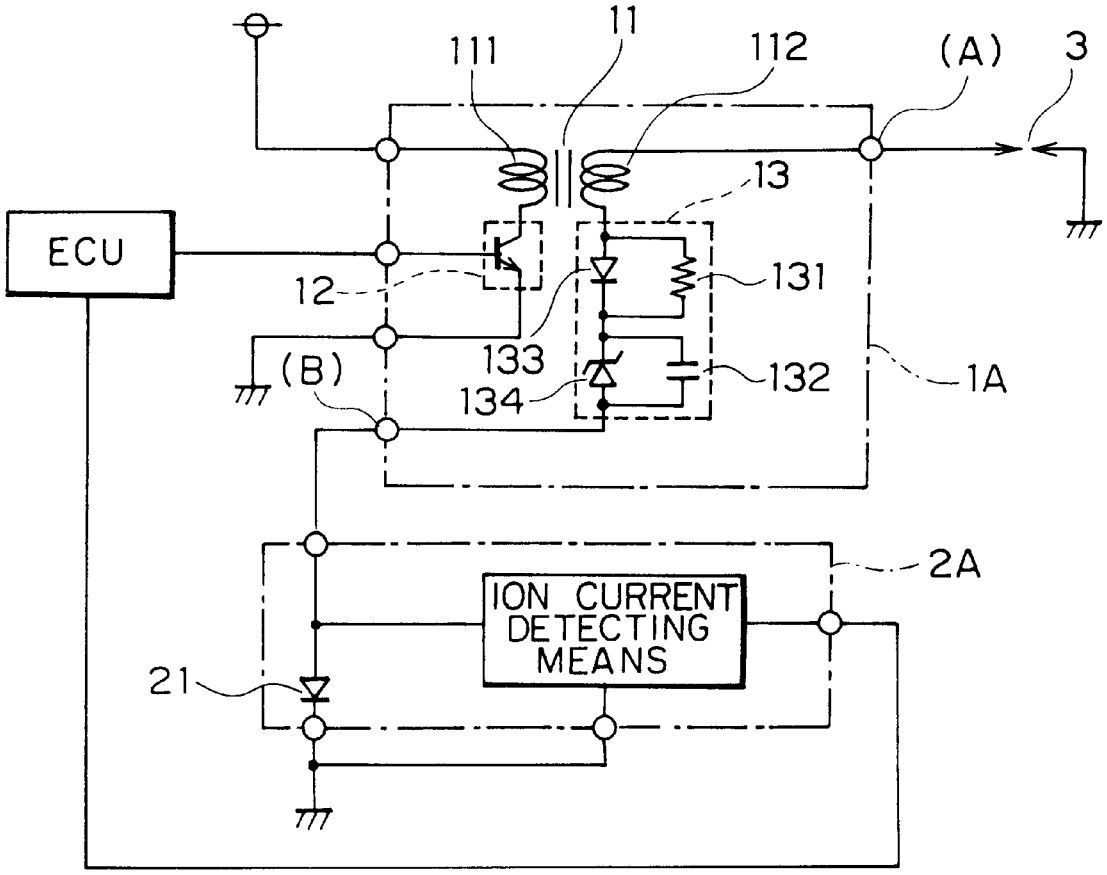
FIG. 1 is a circuit diagram showing an electrical configuration of a combustion state detecting apparatus for an internal combustion engine according to a first embodiment of the present invention.

The present invention will be described in detail in conjunction with what is presently considered as preferred or typical embodiments thereof by reference to the accompanying drawings. In the following description, like reference characters designate like or corresponding parts throughout the several views. Also in the following description, it is to be understood that such terms as "top", "bottom" and the like are words of convenience and are not to be construed as limiting terms.

Embodiment 1

Figure 7:
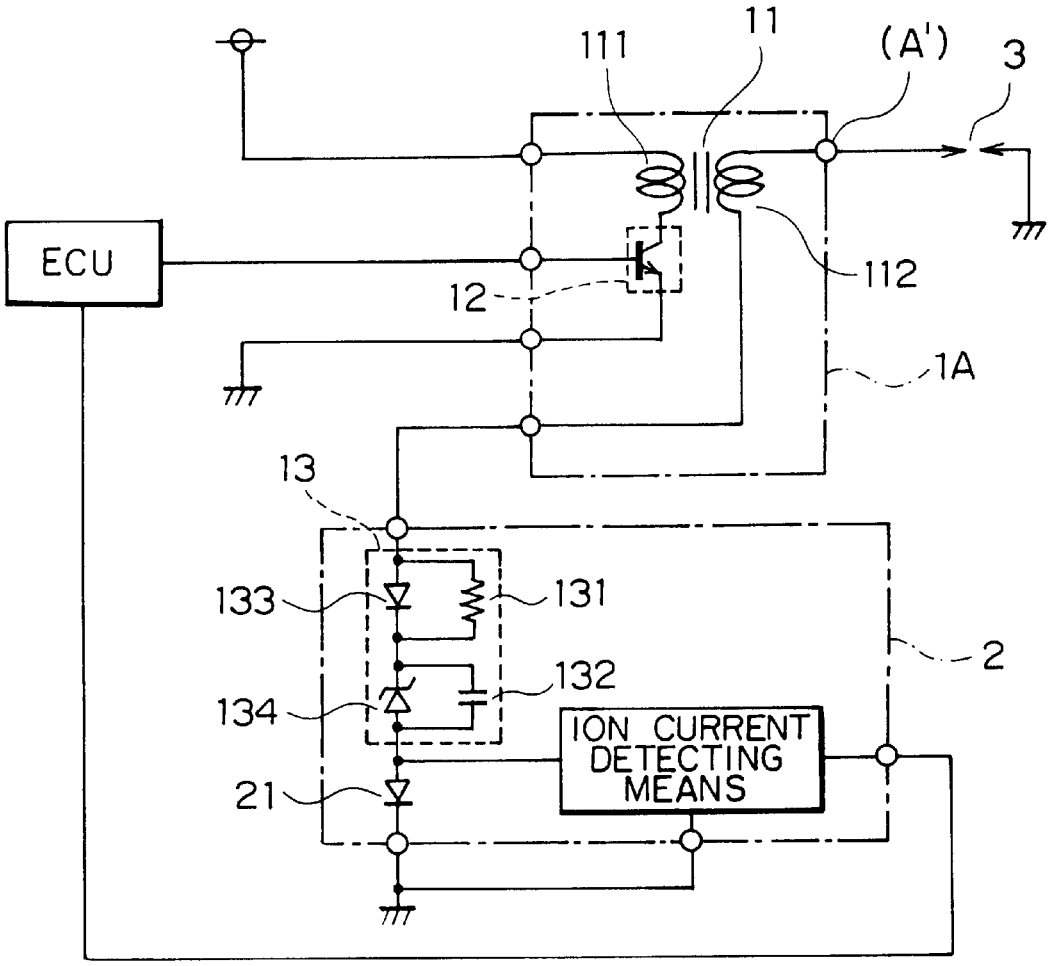
FIG. 7 PRIOR ART
FIG. 7 is a circuit diagram showing an electrical configuration of a conventional combustion state detecting apparatus for an internal combustion engine.

FIG. 1 is a circuit diagram showing a configuration of a combustion state detecting apparatus for an internal combustion engine according to a first embodiment of the present invention. In the figure, components similar or equivalent to those mentioned hereinbefore by reference to FIG. 7 are denoted by like reference numerals, and repeated description thereof is omitted. Referring to FIG. 1, reference character 1A denotes generally a circuit configuration of an ignition device 1A of the combustion state detecting apparatus according to the present invention As can be seen in the FIG. the bias circuit 13 which is incorporated in the combustion state detecting module 2 of the conventional combustion state detecting apparatus is built in the ignition device 1A in the case of the combustion state detecting apparatus according to the instant embodiment of the invention.

More specifically, the bias circuit 13 is disposed in the vicinity of the transformer 11, being electrically connected to the combustion state detecting module 2 by a wiring conductor. By virtue of this structure, even when a breakage fault occurs at a circuit point (A) where the high-potential end of the secondary winding 112 is electrically connected to the spark plug 3 or when misfire event takes place within the engine cylinder in which the spark plug 3 is disposed, the high voltage making appearance at a circuit point (B) at which the bias circuit 13 and the combustion state detecting module 2A are electrically interconnected can be suppressed to a low level through cooperation of the Zener diode 134 and the resistor 131. Thus, the electronic circuitry such as the ion current detecting means incorporated in the combustion state detecting module 2A can be protected against adverse influence of a leak current which would otherwise be brought about by the high voltage mentioned above.

Figure 2:
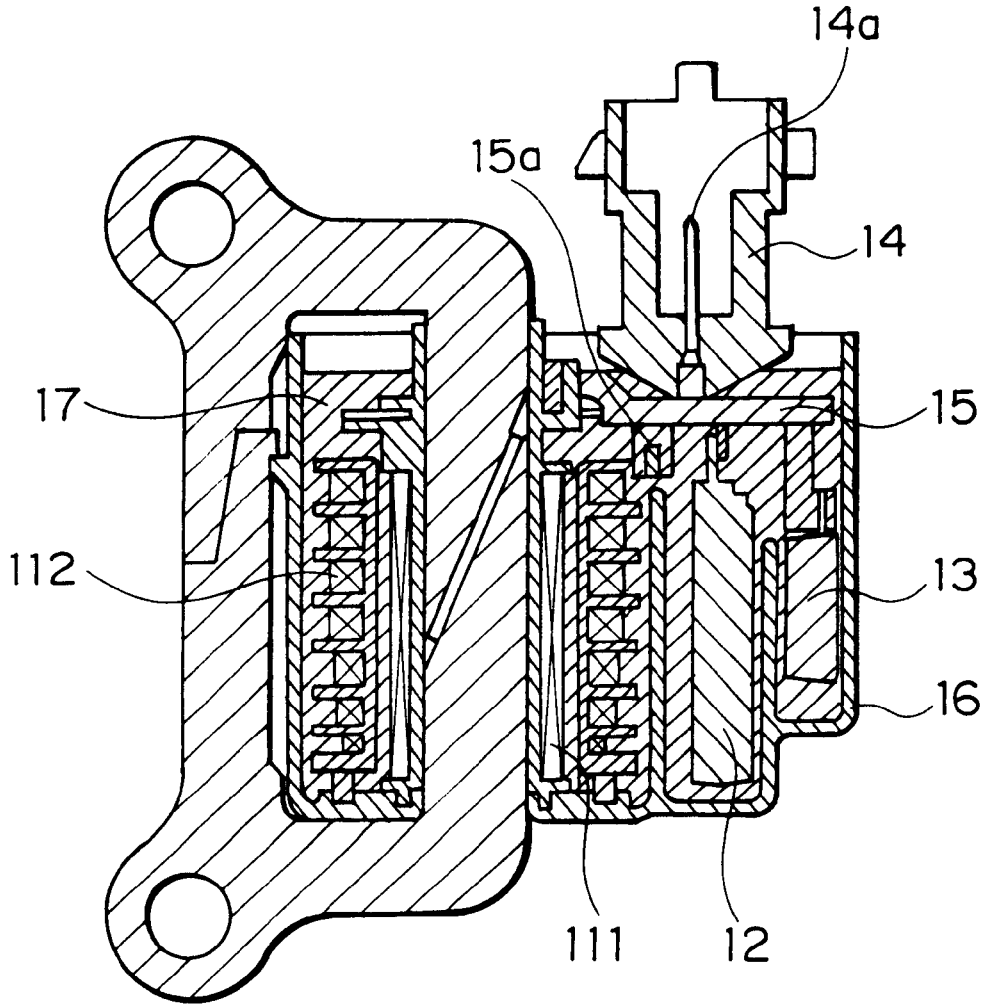
FIG. 2 is a sectional view showing a mechanical structure of the combustion state detecting apparatus for the internal combustion engine according to the first embodiment of the invention.

Next, description will be directed to a mechanical structure of the ignition device 1A according to the instant embodiment of the invention by reference to FIG. 2 which shows the ignition device in a sectional view. Referring to the figure, the switching element 12 having a high heat withstanding capability (high heat resistance) is disposed at a location adjacent to the transformer 11 including the primary winding 111 where heat generation is most rampant in the ignition device 1A, whereas the bias circuit 13 including the capacitor 132 which has a relatively low heat resistance is disposed at a location adjacent to the switching element 12 remotely from the transformer 11.

A connector 14 for electrically connecting the apparatus to other equipment is disposed in such orientation that the connector 14 projects outwardly from the wiring conductor 15 electrically connecting the switching element 12 and the bias circuit 13 through a top opening of the outer packaging case 16, wherein the transformer 11, the switching element 12 and the connector 14 are electrically inter-connected by the wiring conductor 15 which is buried in a block formed of a moldable resin in an integral structure.

The bias circuit 13 is electrically connected to the low-potential end of the secondary winding 112 of the transformer 11 by a wiring conductor 15*a,* the high-potential end of the secondary winding 112 being electrically connected to the wiring conductor 15. The connector 14 which has connecting pins 14*a* for electrically connecting the apparatus to other equipment is disposed in such orientation that the connecting pins 14*a* projects outwardly from the wiring conductor 15 electrically interconnecting the switching element 12 and the bias circuit 13 through the top opening of the outer packaging case 16.

The transformer 11, the switching element 12, the bias circuit 13 and the wiring conductors 15; 15*a* are positionally fixed by a curable casting resin 17 poured through the top opening of the outer packaging case 16.

Figure 3:
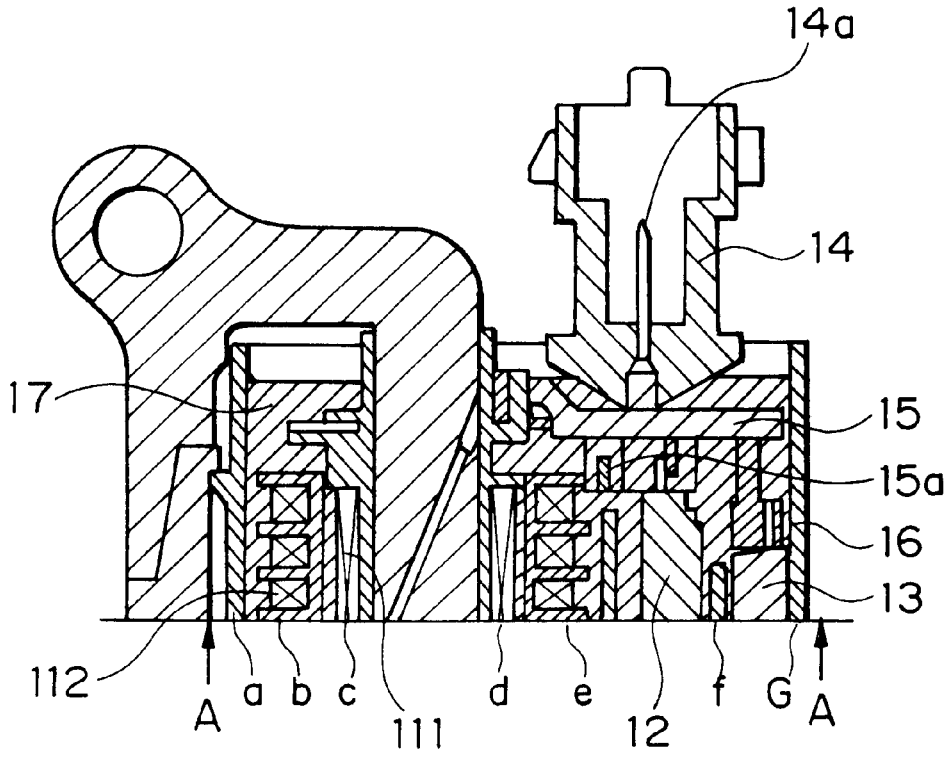
FIG. 3 is a view for graphically illustrating a temperature distribution internally of an outer packaging case of the combustion state detecting apparatus according to the first embodiment of the invention.
Figure 3:
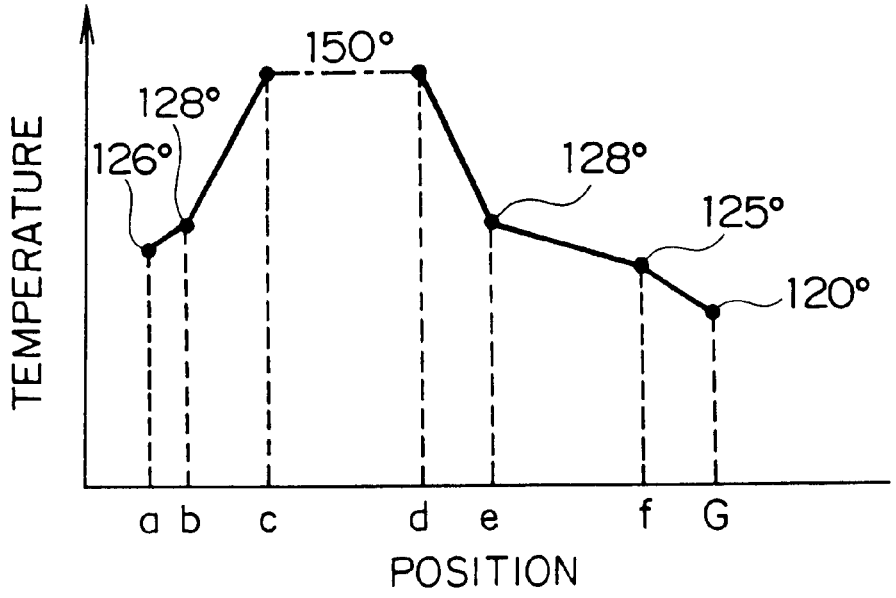

FIG. 3 is a view for graphically illustrating, by way of example, a temperature distribution internally of the outer packaging case 16 constituting a part of the combustion state detecting apparatus according to the first embodiment of the invention. At this juncture, it should first be mentioned that such temperature distribution profile will vary in dependence on the ambient temperature of the combustion state detecting apparatus. As can be seen in FIG. 3, the temperature at a location close to the primary winding 111 of the transformer 11 assumes highest value within the outer packaging case 16. Ordinarily, this temperature can rise up to ca. 150 C.

Such being the circumstances, the switching element 12 having a relatively high heat resistance is disposed at the location adjacent to the transformer 11 where the temperature within the outer packaging case 16 is in a range of 128 C. to 125 C. On the other hand, the bias circuit 13 incorporating the capacitor which can withstand the temperature of ca. 125 C. at the highest is disposed most remotely from the transformer 11 with the switching element 12 being interposed therebetween. Thus, the temperature to which the bias circuit 13 is exposed is in the range of 125 C. to 120 C. whereby the capacitor 132 can be protected against adverse influence of the heat transferred from the transformer 11.

Figure 4A:
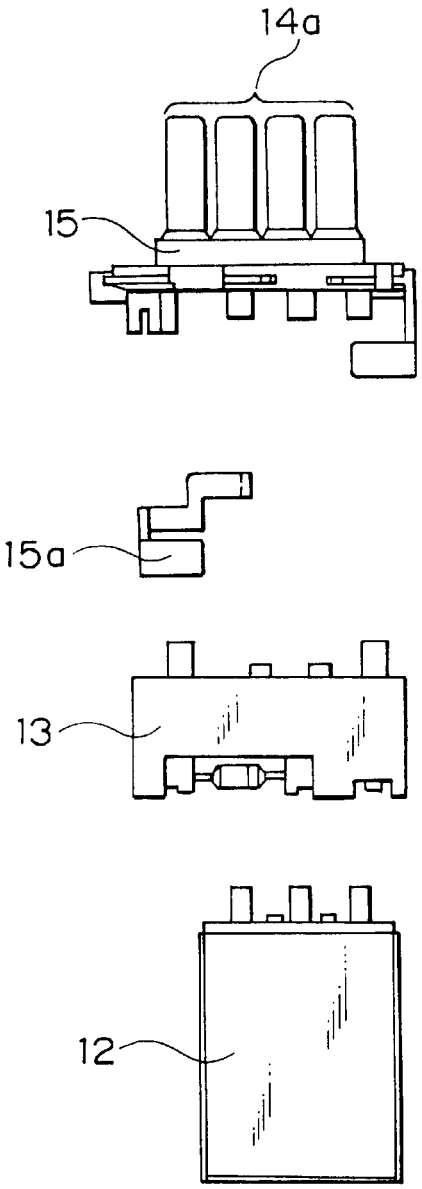
FIGS. 4A and 4B are views for illustrating a process for assembling the ignition device of the combustion state detecting apparatus according to the first embodiment of the invention.
Figure 4B:
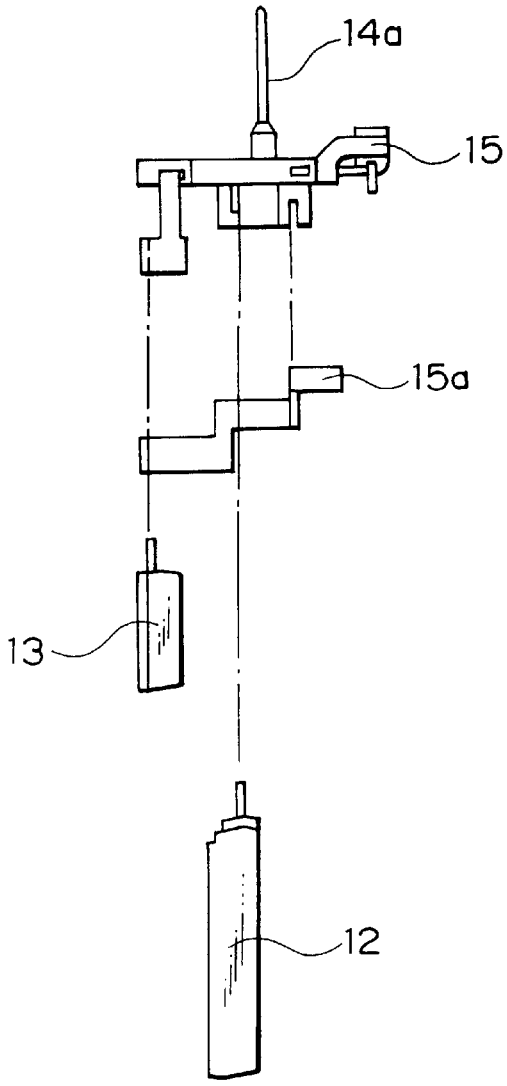

FIGS. 4A and 4B are views for illustrating a process for assembling the ignition device 1A. Referring to FIG. 4A, the wiring conductors 15 employed for electrically interconnecting the primary winding 111 and the secondary winding 112 of the transformer 11, the bias circuit 13 and the switching element 12 are formed integrally with the connecting pins 14*a* of the connector 14 by punching an electrically conductive plate with a die and casted by resin into an insert block, whereas the wiring conductor 15*a* for electrically connecting the bias circuit 13 to the low-potential end of the secondary winding 112 is formed as a discrete part.

For assembling the ignition device 1A, the wiring conductor 15*a* is mounted on the casted resin block in which the wiring conductors 15 are embedded through complementary engagement, as shown in FIG. 4B. Subsequently, one end of the bias circuit 13 is electrically coupled to the wiring conductor 15*a* with the other end of the bias circuit 13 being electrically coupled to one of the pins 14*a* formed integrally with the wiring conductors 15. The terminal electrodes of the switching element 12 are electrically coupled to another one of the connecting pins 14*a* formed integrally with the wiring conductor 15 and a connecting portion of the low-potential end of the primary winding 111, respectively.

Figure 5B:
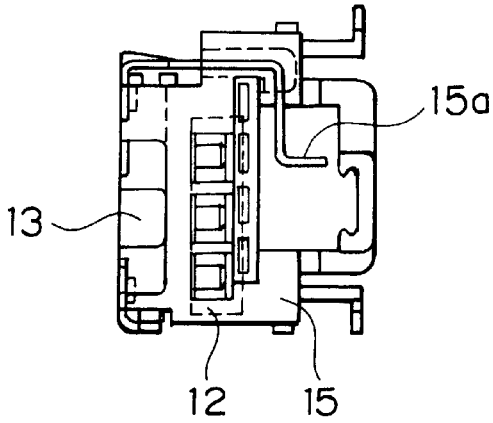
Figure 5A:
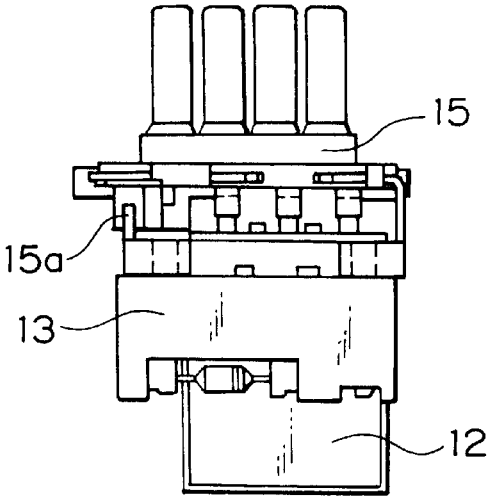
Figure 5C:
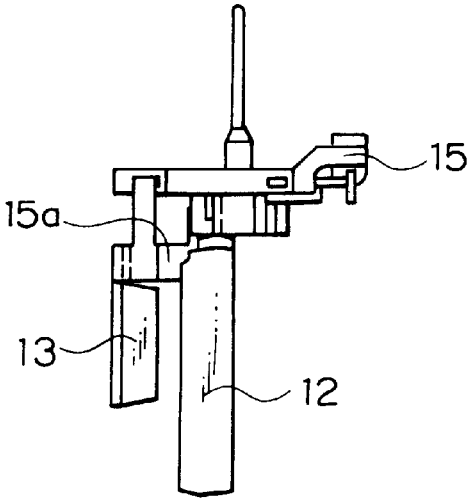

FIGS. 5A, 5B and 5C are views for illustrating outer appearances of the components of the combustion state detecting apparatus in the assembled state. More specifically, FIG. 5A shows in a front view the ignition device 1A in the assembled state, FIG. 5B shows the same in a top plan view, and FIG. 5C shows the same in a side elevational view.

As can be seen from FIGS. 5A to 5C, the wiring conductor 15*a* formed as the discrete part for electrically coupling the bias circuit 13 to the low-potential end of the secondary winding is mounted at a position at which the wiring conductor 15*a* does not affect the outer size and shape of the ignition device while ensuring a predetermined insulation distance from the group of low-voltage wiring conductors (wiring conductors 15).

As will now be understood from the foregoing description, in the combustion state detecting apparatus according to the first embodiment of the invention, the bias circuit 13 is disposed at the position adjacent to the switching element 12 remotely from the transformer 11. By virtue of such disposition, the capacitor 132 constituting a part of the bias circuit 13 can evade the influence of the heat generated by the primary winding 111 whose temperature rises highest among the components of the ignition device 1A, whereby the ignition device ensuring high operation reliability can be realized.

Furthermore, owing to such structure that the wiring conductor 15*a* for electrically coupling the bias circuit 13 to the low-potential end of the secondary winding 112 in which a high voltage is induced is implemented as the discrete component or part which is designed to be mounted onto the wiring conductor 15, a high degree of freedom can be assured for the disposition of the wiring conductor 15*a* relative to the wiring conductor 15. Besides, there can easily be realized an adequate insulation distance between the wiring conductor 15*a* and the wiring conductor group (15).

Embodiment 2

Figure 6:
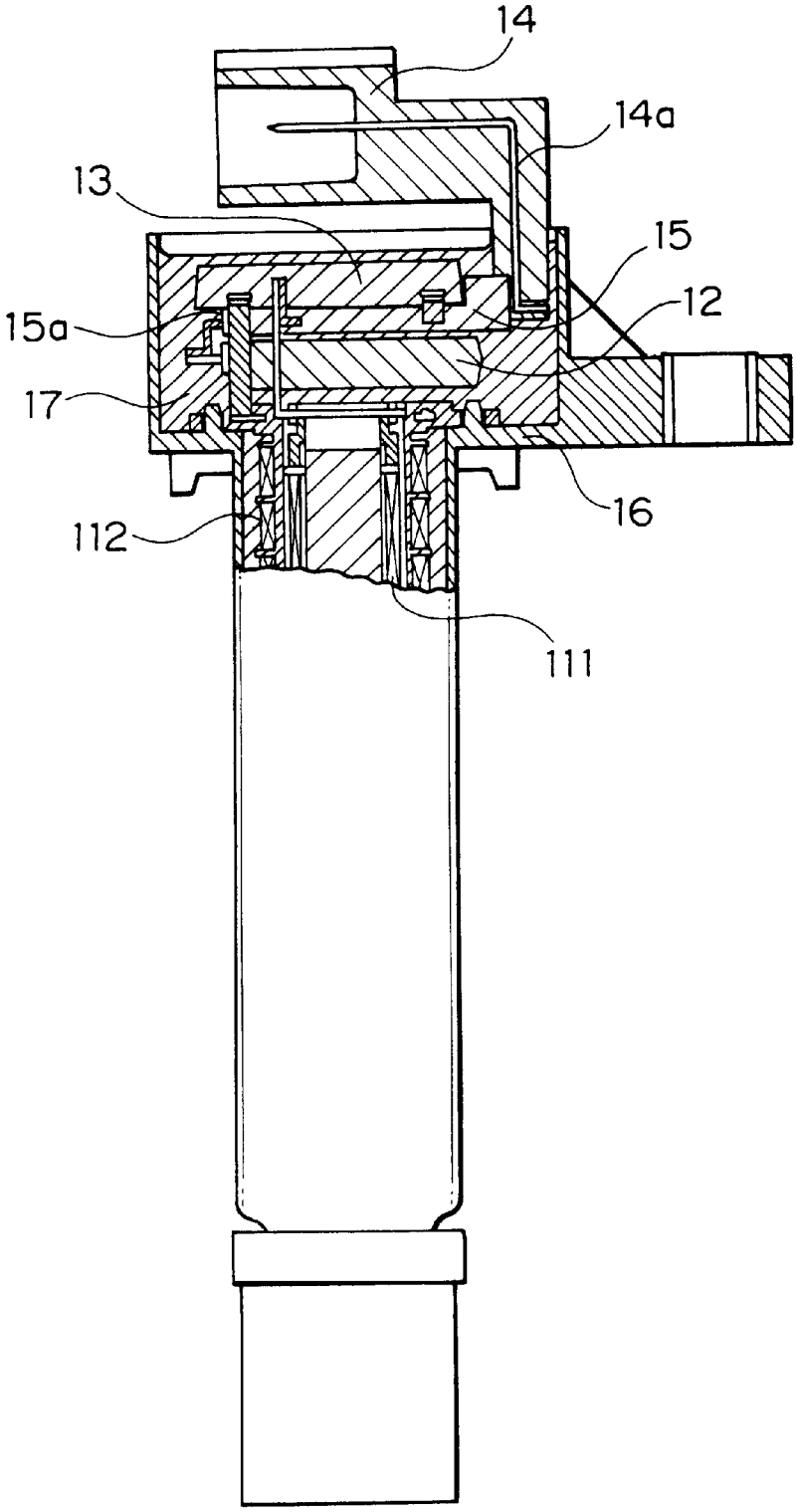
FIG. 6 is a side elevational view showing partially in section an ignition device of the combustion state detecting apparatus for the internal combustion engine according to a second embodiment of the present invention.

FIG. 6 is a side elevational view showing partially in section an ignition device of the combustion state detecting apparatus according to a second embodiment of the present invention. In the case of the ignition device according to the first embodiment of the invention, the wiring conductor 15 is disposed orthogonally to the windings of the transformer 11 with the switching element 12 and the bias circuit 13 being disposed below the wiring conductor 15.

By contrast, in the case of the ignition device according to the second embodiment of the invention, the switching element 12 and the bias circuit 13 are stacked above the windings of the transformer 11 with the wiring conductor 15 being interposed between the switching element and the bias circuit internally of the outer packaging case 16, wherein the connecting pins 14*a* of the connector 14 mounted at the top of the outer packaging case 16 are bent by 90 relative to the longitudinal axis of the transformer. Owing to this structure, the combustion state detecting apparatus as a whole can be realized in a miniaturized structure without imposing essentially any geometrical restriction to a slender structure of the transformer.

Many modifications and variations of the present invention are possible in the light of the above techniques. It is therefore to be understood that within the scope of the appended claims, the invention may be practiced otherwise than as specifically described.

What is claimed is:

1. A combustion state detecting apparatus for an internal combustion engine, comprising:

a transformer including a primary winding and a secondary winding electromagnetically coupled such that upon interruption of a current flowing through said primary winding, a high voltage is induced at a high-potential end of said secondary winding;

switching means (12) having a relatively high heat tolerance level for controllably interrupting the current flowing through said primary winding;

a spark plug for generating a spark discharge in response to application of the high voltage making appearance at the high-potential end of said secondary winding;

bias means (13) having a relatively low heat tolerance level for applying a voltage of positive polarity to a low-potential end of said secondary winding of said transformer to implement the detection of ions produced when the spark discharge occurs at said spark plug; and an outer packaging case for accommodating therein said transformer, said switching means and said bias means, wherein said bias means is disposed within said outer packaging case at a location adjacent to said switching means and remote from said transformer, with said switching means being interposed between said transformer and said bias means, and wherein said outer packaging case is filled with a moldable resin.

2. A combustion state detecting apparatus for an internal combustion engine according to claim 1, further comprising:

a first wiring conductor for electrically interconnecting a low-potential end of said primary winding of said transformer and said switching means; and a second wiring conductor for electrically interconnecting a low-potential end of said secondary winding of said transformer and said bias means, wherein said first and second wiring conductors are formed discretely from each other, and wherein said second wiring conductor is disposed at an inner side relative to said first wiring conductor.

3. A combustion state detecting apparatus for an internal combustion engine according to claim 1, wherein said secondary winding surrounds said primary winding.

* * * * *